United States Patent [19]

Troup

[11] 4,195,782

[45] Apr. 1, 1980

[54] METHOD AND DEVICE FOR ENHANCING THE DISTRIBUTION OF WATER FROM A SPRINKLER OPERATED AT LOW PRESSURES

[75] Inventor: Edward M. Troup, Mt. Baldy, Calif.

[73] Assignee: Rain Bird Sprinkler Mfg. Corp., Glendora, Calif.

[21] Appl. No.: 874,833

[22] Filed: Feb. 3, 1978

[51] Int. Cl.[2] ..... B05B 3/16

[52] U.S. Cl. ..... 239/230; 239/544

[58] Field of Search ..... 239/230, 231–233, 239/543, 544

[56] References Cited

U.S. PATENT DOCUMENTS

| | | | |
|---|---|---|---|
| 200,376 | 2/1878 | Daughtrey | 239/544 X |
| 442,762 | 12/1890 | Wainwright | 239/544 X |
| 3,592,386 | 7/1971 | Tschudy, Jr. | 239/543 X |
| 3,912,171 | 10/1975 | Johnson | 239/230 |

*Primary Examiner*—John J. Love

*Attorney, Agent, or Firm*—Fulwider, Patton, Rieber, Lee & Utecht

[57] ABSTRACT

For use in a sprinkler system, a method and device for enhancing the distribution of water from an impact or reaction drive sprinkler comprising a nozzle which separates the flow of water through the sprinkler into two distinct and separate streams, and directs the separate streams such that they intersect at a point downstream of the nozzle to break the stream into small droplets for enhanced distribution when water is supplied to the sprinkler at relatively low pressures.

8 Claims, 3 Drawing Figures

METHOD AND DEVICE FOR ENHANCING THE DISTRIBUTION OF WATER FROM A SPRINKLER OPERATED AT LOW PRESSURES

BACKGROUND OF THE INVENTION

This invention relates generally to irrigation sprinklers of the impact or reaction drive types, and, more particularly, to a method and device for enhancing water distribution from such sprinklers when operated at low pressures.

As is well known in the art, it is highly desirable for each impact or reaction driven sprinkler in a system to provide an even distribution of water over its entire range of throw. One way in which this has been accomplished is by providing water to the sprinklers at relatively high pressures so the sprinklers produce a spray of water consisting of droplets of relatively small size. Typically, for a given sprinkler and nozzle size, there is a minimum pressure above which water must be supplied to the sprinkler to achieve satisfactory water distribution and sprinkler operation.

By way of example, as shown in the 1977 Irrigation Equipment Catalogue published by Rain Bird Sprinkler Mfg. Corp. of Glendora, Calif., for a full circle Model 30 sprinkler with a nozzle size of 3/16 inch, a minimum supply pressure of 45 pounds per square inch (psi) is required to achieve satisfactory water distribution and sprinkler operation. If the pressure is allowed to fall below this required level, the droplet size of the spray increases dramatically and the distribution pattern will deteriorate appreciably.

When the spray is comprised of large droplets, a high percentage of the water is concentrated at the outer edges of the spray pattern, and when the large droplets fall to the ground, they tend to pack the soil thereby decreasing its permeability to water. This decreased permeability causes loss of water from runoff and evaporation before the water can be absorbed into the soil.

Large amounts of energy are required to maintain the supply pressure necessary to produce the desirable small droplets. In the well known pivot move type sprinkler systems, for example, it is often necessary to provide high capacity supply pumps typically run by natural gas or electricity, and often even booster pumps along the supply line in order to maintain the required pressure. The cost of the energy consumed by high capacity supply pumps, in addition to the booster pumps, significantly increases the cost of operating such sprinkler systems.

Accordingly, there exists a need for a convenient, effective and economical device for enhancing the water distribution from sprinklers which is capable of operating at energy saving low pressures. As will become apparent from the following, the present invention satisfies that need.

SUMMARY OF THE INVENTION

The present invention resides in a new and improved nozzle and method of operation for use in irrigation sprinklers of the impact and reaction drive types and by which water may be evenly distributed over the range of the sprinkler even when operating at relatively low supply pressures. This is accomplished generally by a new and improved nozzle which separates the stream of water flowing through the sprinkler into at least two separate and distinct streams of water, and directs these distinct streams such that they intersect at a predetermined angle after being ejected from the nozzle. On intersection of the streams, the resultant stream is broken into sufficiently small droplets to provide the desired distribution of water by the sprinkler.

More specifically, the nozzle of the present invention includes means for separating the water supplied to the sprinkler into two distinct streams, and imparting directions to the distinct streams which cause them to intersect a specified distance away from the nozzle. Toward this end, the nozzle includes a centrally located wall for separating the stream of water into at least two distinct streams, and converging surfaces adjacent the downstream end of the nozzle for imparting the desired directions to the distinct streams of water causing the streams to intersect and produce stream break up into small droplets without interfering with the sprinkler drive.

Other features and advantages of the present invention will become apparent from the following detailed description, taken in conjunction with the accompanying drawings, which illustrate, by way of example, the principles of the invention.

DETAILED DESCRIPTION

Figure 1:
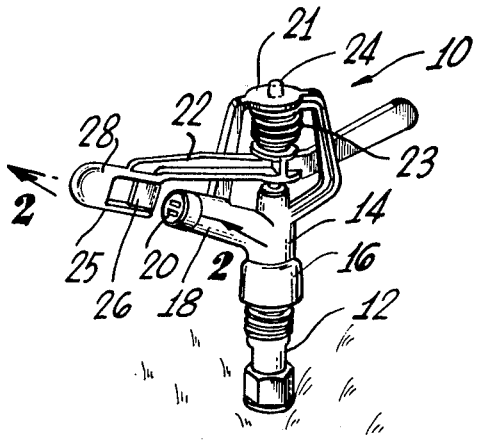
FIG. 1 is a perspective view of a nozzle embodying the present invention, and illustrated assembled together with a conventional sprinkler of the impact drive type.

As shown in the exemplary drawings, the present invention is embodied in a nozzle for use with an irrigation sprinkler of the impact or impulse drive type, and herein is shown in the drawings as an impact drive type sprinkler, indicated generally by reference numeral 10 in FIG. In this instance, the sprinkler 10 is mounted for rotation about a vertical axis on a water supply pipe or riser 12, and includes a main body 14 having a lower inlet portion 16. Extending upwardly and outwardly from the inlet portion 16 of the body 14 is a central portion 18 having an internal conduit 19 (FIG. 2) through which water travels to a nozzle 20.

When in use, water is admitted under supply pressure into the sprinkler 10 through the riser 12, and travels through the internal conduit 19 in the central portion 18 to the nozzle 20. The nozzle 20 ejects the water upwardly and outwardly away from the sprinkler 10, the distance of throw being a function of sprinkler and nozzle size, and the supply pressure of the water admitted to the sprinkler.

To drive the sprinkler 10, an impact arm 22 herein is mounted for rotation about a vertical axis on a pin 24 upstanding from the central portion 18 of the body 14 and supported at its upper end by a bridge portion 21 integrally formed with the body 14. The arm 22 is biased by a spring 23 to the position shown in FIG. 1 and includes a drive spoon 25 having an inner water deflecting vane 26 and an outer water deflecting portion 28 disposed at one end of the arm.

The operation of the impact arm 22 to drive the sprinkler 10 is well known in the art, and it is not believed necessary to describe that operation in detail here. It is sufficient for the purposes of this invention to point out that during the operation of the sprinkler 10, the water deflecting vane 26 and portion 28 intermittently enter the stream of water emitted from the nozzle 20 causing the arm 22 to impact against the bridge portion 21 of the body 14 thereby imparting to the sprinkler 10 an increment of rotational movement.

In accordance with the present invention, the nozzle 20 of the sprinkler 10 includes means for enhancing water distribution over the entire range of the sprinkler 10 when the water supply pressure to the sprinkler is below the minimum pressure normally required for satisfactory operation of that sprinkler. Further, the nozzle 20 of the invention produces relatively small droplets at low pressures, yet provides a stream capable of driving the sprinkler in a reliable and effective manner while operating at low pressures.

Toward the foregoing end, the nozzle 20 herein is received in one end of a cylindrical housing 30 having a wall 32 which is disposed around the nozzle 20, and which has its outer end crimped or rolled over the outer end of the nozzle 20, as shown at 34, in order to hold the nozzle 20 firmly within the housing 30. The housing 30 is herein threadably received in the downstream end of the conduit 19 of the sprinkler body 14.

Figure 2:
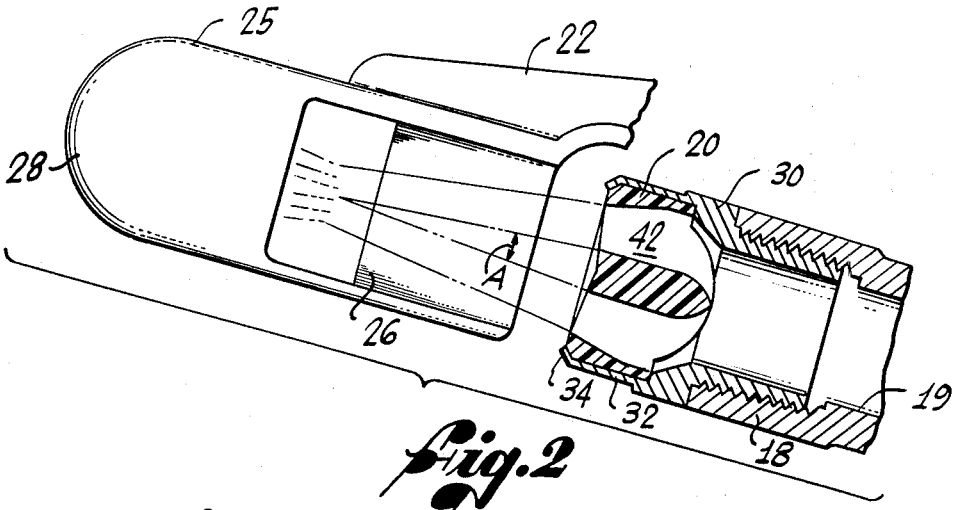
FIG. 2 is an enlarged, fragmentary, partly sectional view of the nozzle of the present invention and taken substantially along line 2—2 of FIG. 1.
Figure 3:
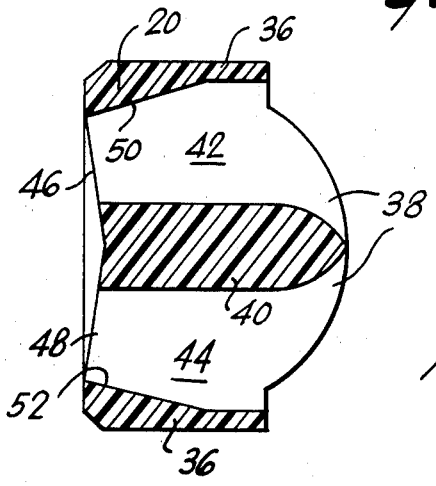
FIG. 3 is a further enlarged sectional view of the nozzle of the invention taken substantially along line 2—2 of FIG. 1.

As can best be seen in FIGS. 2 and 3, the nozzle 20, which herein is shown formed from moldable plastic, includes a generally cylindrical body portion 36 defining a central passage 38 which receives a stream of water from the riser 12 through the internal conduit 19 within the sprinkler 10. The stream of water is separated into two distinct streams of water by a generally horizontal wall 40 which is centrally disposed in the nozzle 20. The wall 40 divides the central passage 38 into an upper passage 42 and a lower passage 44 for conducting the separate streams of water. The upper passage 42 terminates at an upper outlet aperture 46, and the lower passage 44 terminates at a lower outlet aperture 48. The upper passage 42 and the lower passage 44 include converging inner surfaces 50 and 52 adjacent the downstream ends of the passages 42 and 44, respectively, so that water flowing through the upper passage 42 is deflected downwardly as it is emitted from the outlet aperture 46, and water flowing through the lower passage 44 is deflected upwardly as it is emitted from the outlet aperture 48.

The deflection imposed upon the distinct streams by the nozzle 20 causes the streams to intersect at an acute angle A at a point downstream of the nozzle 20, and as the streams intersect, they are caused to break into relatively small droplets, thereby enhancing the distribution of water from the sprinkler 10. Extensive experimentation has revealed that stream breakup and drop size distribution over the range of throw of the sprinkler are satisfactory when the streams of water intersect at an included angle A of between about 7½ degrees and about 40 degrees. At angles of less than 7½ degrees, the stream does not break up satisfactorily, and at angles of greater than 40 degrees, excessive back-splash is created.

In practice, the maximum angle of intersection between the streams is limited by the structural design of the sprinkler with which the nozzle of the present invention is being used. That is, in order to drive the sprinkler in a reliable and effective manner as described above, the distinct streams ejected from the nozzle 20 must impinge upon the inner water deflecting vane 26 of the spoon 25 before their point of intersection so that both streams are collimated as they operate on the vane 26.

This can be accomplished by arranging spacing between the outlet apertures 46 and 48, and the distance between the nozzle outlet and the vane 26, to accomodate this requirement. If it is desired to employ the nozzle of the present invention with a standard design sprinkler presently in use, the angle of intersection of the streams can be selected to accomodate the existing structural design of that sprinkler. By way of example, for use with a Model 30 sprinkler manufactured by Rain Bird Sprinkler Mfg. Corp. of Glendora, Calif. referred to above, the preferred angle of intersection between the streams is about 15 degrees.

In order to cause the streams to intersect at this desired angle, the converging surfaces 50 and 52 are inclined with respect to the axis of the nozzle at an angle of about 15 degrees. The converging surfaces 50 and 52 thereby- impart a direction to each of the distinct streams flowing through the passages 42 and 44 such that each stream forms an angle of about 7½ degrees with respect to the axis of the nozzle, and the streams therefore intersect at an angle of about 15 degrees at a point downstream of the nozzle 20.

Excellent results have been achieved at desirable relatively low supply pressures using the above described nozzle. For example, a full circle Model 30 sprinkler manufactured by Rain Bird Sprinkler Mfg. Corp. of Glendora, Calif., employing the nozzle of this invention at a supply pressure of about 30 psi was able to develop substantially the same distribution pattern and small droplet size as that developed by the same model sprinkler using a conventional 3/16 inch straight bore nozzle and operating at a supply pressure between 45 and 50 psi. Therefore, the desirable even distribution of water from a sprinkler can be achieved at a supply pressure reduction of about 33% to 40 %. Reducing the required supply pressure results in a substantial saving of energy consumed in the operation of a sprinkler system.

From the foregoing, it will be appreciated that the nozzle 20 of the present invention provides a method and device for achieving a desirable even distribution of water from a sprinkler while operating at energy saving, low supply pressure levels. Further, the nozzle 20 may be fabricated conveniently and economically, for example of plastic, and is adaptable for use with substantially any conventional sprinkler of the impact or reaction drive type.

While a particular form of the invention has been illustrated and described, it will be apparent that various modifications can be made without departing from the spirit and scope of the invention.

I claim:

1. An impact drive sprinkler having an impact arm with an inner stream deflecting vane disposed to intermitently enter a stream of water emitted from the sprinkler and a nozzle for enhancing the distribution of water from the sprinkler, said nozzle comprising:

a generally tubular body portion having a passage therethrough, for receiving water supplied to said sprinkler;

means for separating said supply water into at least two distinct streams of water; and means for directing said distinct streams toward each other outwardly of said nozzle such that said streams intersect forming an acute angle of between 7½ degrees and about 40 degrees at a point downstream of said vane.

2. A sprinkler nozzle as set forth in claim 1 in which said means for separating said supply water comprises a wall located centrally in said body portion and dividing said passage into at least two separate passages.

3. A sprinkler nozzle as set forth in claim 1 in which said means for directing said distinct streams comprises converging surfaces in said body portion adjacent the downstream end of said nozzle.

4. A sprinkler nozzle as set forth in claim 1 wherein said nozzle is formed of a moldable plastic material.

5. A sprinkler nozzle as set forth in claim 1 wherein said acute angle is about 15 degrees.

6. In an impact drive sprinkler having a body including an outlet projecting upwardly and outwardly therefrom, an impact arm pivotally mounted on said body and biased by a spring for moving an inner water deflecting vane and an outer water deflecting portion intermittently into and out of a stream of water ejected from said outlet, and a nozzle disposed adjacent said outlet; the improvement wherein said nozzle comprises:

a generally cylindrical body portion having a passage therethrough for receiving water supplied to said sprinkler;

a horizontally disposed central wall dividing said passage into an upper passage and a lower passage for separating said supply of water into an upper stream flowing through said upper passage, and a lower stream flowing through said lower passage;

a first surface in the upper wall adjacent the outlet of said upper passage which is inclined downwardly for deflecting the upper stream downwardly toward the axis of said nozzle, and a second surface in the lower wall adjacent the outlet of said lower passage which is inclined upwardly for deflecting the lower stream upwardly toward the axis of said nozzle and causing said lower stream to intersect said upper stream at an acute angle at a point downstream of said inner water deflecting vane.

7. A sprinkler as set forth in claim 6 wherein said acute angle is between about 7½ degrees and about 40 degrees.

8. A sprinkler as set forth in claim 6 wherein said acute angle is about 15 degrees.

* * * * *